US010147566B2

(12) United States Patent
Dankert

(10) Patent No.: US 10,147,566 B2
(45) Date of Patent: Dec. 4, 2018

(54) SWITCH, IN PARTICULAR POWER SWITCH, FOR LOW VOLTAGES

(71) Applicant: Siemens Aktiengesellschaft, München (DE)

(72) Inventor: Mario Dankert, Raguhn-Jessnitz (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 261 days.

(21) Appl. No.: 14/652,869

(22) PCT Filed: Feb. 18, 2014

(86) PCT No.: PCT/EP2014/053076

§ 371 (c)(1),
(2) Date: Jun. 17, 2015

(87) PCT Pub. No.: WO2014/135363

PCT Pub. Date: Sep. 12, 2014

(65) Prior Publication Data

US 2015/0364272 A1 Dec. 17, 2015

(30) Foreign Application Priority Data

Mar. 8, 2013 (DE) ..... 10 2013 203 985

(51) Int. Cl.
*H01H 9/54* (2006.01)
*H01H 71/12* (2006.01)

(52) U.S. Cl.
CPC ..... *H01H 9/54* (2013.01); *H01H 71/125* (2013.01); *H01H 71/127* (2013.01)

(58) Field of Classification Search
CPC ..... H01H 9/54; H01H 71/125; H01H 71/127
See application file for complete search history.

(56) References Cited

U.S. PATENT DOCUMENTS 4,271,447 A * 6/1981 Howell ..... H02H 1/066 361/93.7

FOREIGN PATENT DOCUMENTS

| | | | | |
|---|---|---|---|---|
| CN | 1856856 | A | 11/2006 | |
| DE | 19843245 | A1 | 8/1999 | |
| DE | 102005047042 | A1 | 4/2007 | |
| DE | 102009033542 | A1 | 1/2011 | |
| DE | 102011083583 | A1 | 3/2013 | |
| EP | 0186171 | * | 12/1984 | ..... H04H 3/3042 |
| WO | WO-9914779 | A1 | 3/1999 | |

OTHER PUBLICATIONS

International Search Report PCT/ISA/210 for International Application No. PCT/EP2014/053076 dated May 2, 2014.

* cited by examiner

*Primary Examiner* — Zeev V Kitov
(74) *Attorney, Agent, or Firm* — Harness, Dickey & Pierce, P.L.C.

(57) ABSTRACT

A switch is disclosed, in particular a power switch, for low voltages. The switch includes mechanically separable contact elements, in abutment when the switch is closed and via which a current to be monitored flows through the switch, an electronic trigger unit, which triggers a respective contact mechanics unit if a current condition is satisfied. In the event of triggering, the contacts are separated and the switch is switched on via the contact mechanics unit. A supply unit is included to extract a first electric energy from the current flowing through the switch to supply the trigger unit with energy. To guarantee energy supply even when switching to a short-circuit, the contact mechanics unit is coupled to a conversion unit, which converts a portion of the mechanical energy to be provided during switching-on into a second electric energy that supplies the trigger unit with electric energy during switching-on.

6 Claims, 1 Drawing Sheet

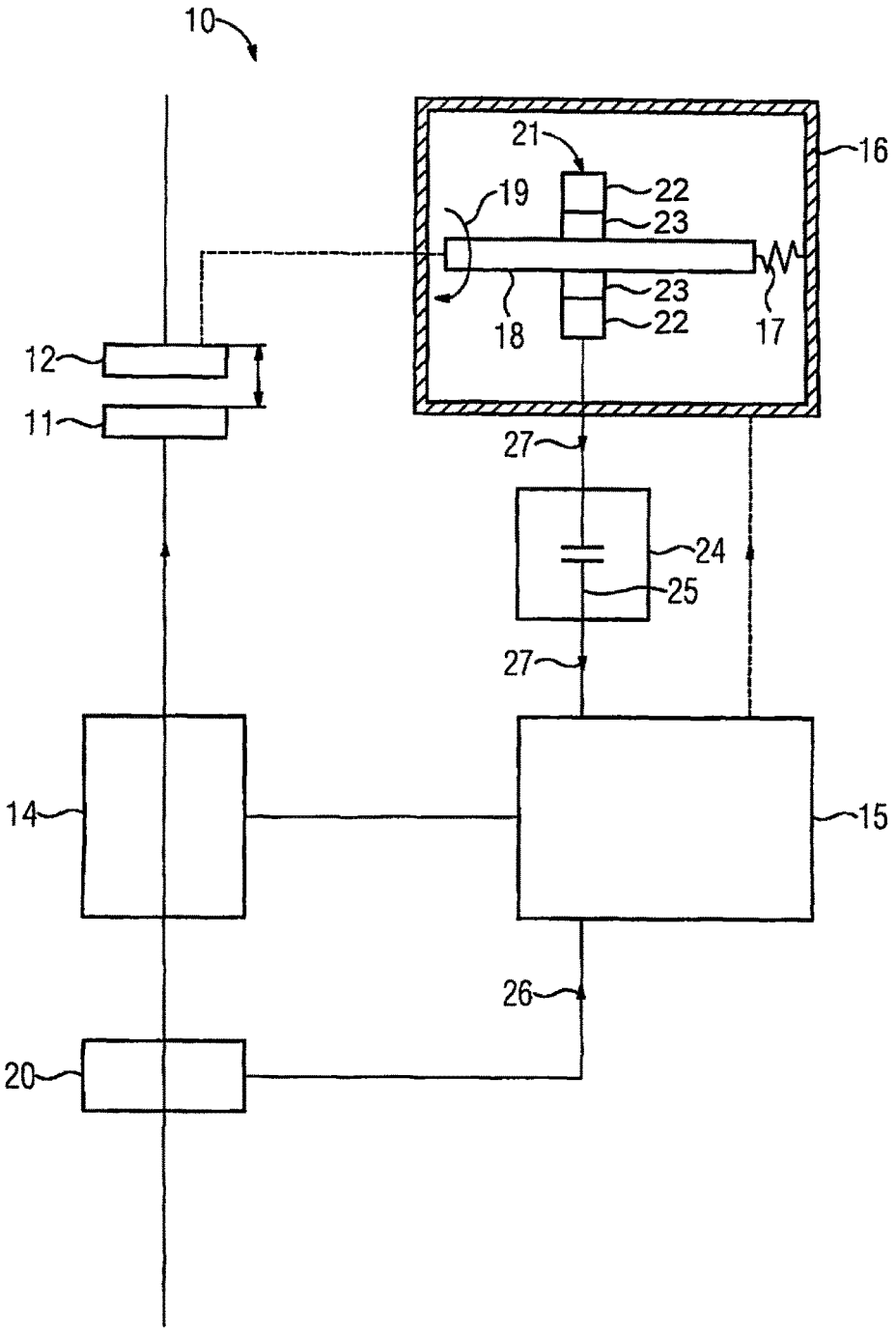
10
21
16
19
22
23
23
22
18
17
12
11
27
24
25
27
14
15
26
20

SWITCH, IN PARTICULAR POWER SWITCH, FOR LOW VOLTAGES

PRIORITY STATEMENT

This application is the national phase under 35 U.S.C. § 371 of PCT International Application No. PCT/EP2014/053076 which has an International filing date of Feb. 18, 2014, which designated the United States of America and which claims priority to German patent application number 102013203985.9 filed Mar. 8, 2013, the entire contents of each of which are hereby incorporated herein by reference.

FIELD

At least one embodiment of the invention generally relates to a circuit breaker.

BACKGROUND

Power circuit breakers for low voltages are known and are used to protect electric grids and the like. They have mechanically separable contact elements which are in abutment when the breaker is closed. The current to be monitored flows through the breaker and via the contact elements. An electronic trigger unit checks in each case whether a predefined current condition has been met. In the case that the current condition has been met, separation of the contact elements is triggered. A contact mechanics unit, which has a breaker shaft which is rotatably mounted about the longitudinal axis thereof, is used to separate the contact elements in the event of triggering and to switch on the breaker, that is to say to connect the contact elements which are separated from one another.

In order to supply power to the trigger unit, in each case the required electric power is drawn from the electric current flowing through the breaker by means of a current transformer, that is to say that the trigger unit has an internal power supply. It therefore draws its electric power from the grid which is intended to be protected by the power circuit breaker.

Switching to a short circuit represents the worst case for the power supply of the electronic trigger unit. The current transformer must then provide the power for the (electronics of the) trigger unit, measure and evaluate the current and generate a trigger signal in the shortest possible time. The current transformers must be appropriately configured for this case.

In the case of a DC grid, an inductive current transformer can be installed for switching to a short circuit, in order to ensure the power supply to the trigger unit.

Document DE 10 2011 083583 A1 discloses in this connection a breaker, in particular power circuit breaker for low voltages, for interrupting an electric current flowing through a conductor.

Document WO 99/14779 A1 discloses an arrangement for obtaining an auxiliary power for the operation of a trigger system of a low-voltage power circuit breaker.

SUMMARY

The inventors discovered that it is disadvantageous that the power supply which is configured for normal operation cannot always guarantee that there is sufficient power available in each case, that is to say even in the case of other operating conditions.

At least one embodiment provides that an electric generator comprising a stationary and a displaceable part is arranged at the breaker shaft such that the displaceable part is fixed to the breaker shaft, wherein the generator converts some of the mechanical energy to be applied during switching-on into electric power which supplies the trigger unit with power in each case during switching-on.

BRIEF DESCRIPTION OF THE DRAWINGS

The invention is explained once again below with reference to the enclosed FIGURES on the basis of example embodiments. In these example embodiments the same components in different FIGURES are provided with identical reference numbers. In the FIGURES:

FIG. 1 shows a schematic diagram of an example embodiment of a breaker.

DETAILED DESCRIPTION OF EXAMPLE EMBODIMENTS

At least one embodiment provides that an electric generator comprising a stationary and a displaceable part is arranged at the breaker shaft such that the displaceable part is fixed to the breaker shaft, wherein the generator converts some of the mechanical energy to be applied during switching-on into electric power which supplies the trigger unit with power in each case during switching-on.

In order to be able to better use the electric power generated by the generator, what is proposed is that the generator charges an energy store.

In the simplest case, the energy store is designed as a capacitor.

The generator is rated such that the generated electric power is in each case sufficient to check during switching-on whether the current condition has been met and, if the current condition has been met, to trigger the breaker.

The invention is described in more detail below on the basis of an example embodiment. As shown in FIG. 1, the breaker 10 is designed as a power circuit breaker for low voltages and has (generally for each current phase) in each case a contact which is formed from mechanically separable contact elements in the form of contact pieces 11, 12. One of the two contact pieces is a stationary contact 11 while the other contact 12 is arranged in a displaceable manner. The contact pieces are in abutment when the breaker 10 is closed. The current flows through the breaker 10 via connection lugs and the contact pieces 11, 12 which are in abutment.

An electronic trigger unit 15 acquires the electric power 26 flowing in each case through the breaker 10 via a power transformer 14 (in particular current transformer). If said electric power exceeds a predefined power threshold, that is to say a predefined power condition (or current condition) is met, the trigger unit 15 triggers and the contact pieces 11, are separated from one another, that is to say the displaceable contact element 12 is lifted off the stationary contact element 11.

The contact pieces 11, 12 are separated by way of a contact mechanics unit 16 in the form of a breaker latching mechanism which is tensioned using a spring energy store (energy store) 17. The breaker latching mechanism has a breaker shaft 18 which is mounted rotatably about the longitudinal axis thereof. In order to tension the breaker latching mechanism, the breaker shaft 18 is rotated about the longitudinal axis thereof, against the force of the spring energy store 17, and latched in its end position.

In order to supply power to the trigger unit 15 during running operation, a supply unit 20 is used. This draws a (relatively small) portion of the electric power which flows through the breaker 10. An electromagnetic generator 21 is arranged at the breaker shaft 18. The generator 21 comprises a stationary part 22 and a displaceable part 23, wherein the latter is fixed to the breaker shaft 18.

In this way, a rotary movement 19 of the breaker shaft 18, as occurs during switching-on of the breaker 10, leads to the conversion of mechanical rotary-movement energy into electric power, that is to say that, during switching-on, in each case some of the mechanical energy to be applied is converted into electric power.

The generated electric power 27 charges an energy store 24 in the form of an electric capacitor 25.

Generator 21 and capacitor 25 are dimensioned such that the electric power 27 is in each case sufficient to allow the trigger unit 15 to check during switching-on whether the current condition has been met and, if the current condition has been met, to trigger the mechanically pre-tensioned breaker latching mechanism and hence to trigger the breaker 10.

The invention claimed is:

1. A breaker, comprising:

a fixed contact and a displaceable contact, the fixed contact and the displaceable contact being mechanically separable contact elements, in abutment when the breaker is closed and via which a current to be monitored can flow through the breaker;

a contact mechanics unit to switch on the breaker and to separate the contact elements in the event of triggering, wherein the contact mechanics unit is in the form of a breaker latching mechanism which is tensioned using a spring energy store and wherein the breaker latching mechanism has a breaker shaft which is mounted rotatably about the longitudinal axis of the breaker latching mechanism and in order to tension the breaker latching mechanism, the breaker shaft is rotated about the longitudinal axis of the breaker shaft, against the force of the spring energy store in the rotational direction of the breaker shaft, and latched in its end position;

an electronic trigger unit to trigger the contact mechanics unit upon a current condition being met, wherein, in the event of triggering, the contact elements are separated and the breaker is activated via the contact mechanics unit;

a supply unit to draw a first electric power from the current flowing through the breaker via a power transformer, to supply the electronic trigger unit with power during running operation; and an electric generator, including a stationary and a displaceable part, arranged at the breaker shaft such that the displaceable part is directly fixed to the breaker shaft, the electric generator being coupled to the contact mechanics unit and configured to convert some of the mechanical energy to be applied during switching-on into a second electric power to supply the trigger unit with electric power during switching-on, and wherein a rotary movement of the breaker shaft occurring during switching-on of the breaker leads to the conversion of mechanical rotary-movement energy into the second electric power.

2. The breaker of claim 1, wherein the generator charges an energy store.

3. The breaker of claim 2, wherein the energy store is designed as a capacitor.

4. The breaker of claim 1, wherein the second electric power is sufficient to check during switching-on whether the current condition has been met and, if the current condition has been met, to trigger the breaker.

5. The breaker of claim 2, wherein the second electric power is sufficient to check during switching-on whether the current condition has been met and, if the current condition has been met, to trigger the breaker.

6. The breaker of claim 3, wherein the second electric power is sufficient to check during switching-on whether the current condition has been met and, if the current condition has been met, to trigger the breaker.

* * * * *